United States Patent [19]

Jeschke

[11] 4,030,727

[45] June 21, 1977

[54] SHEET TRANSFER DEVICE FOR PRINTING PRESSES

[75] Inventor: Willi Jeschke, Heidelberg, Germany

[73] Assignee: Heidelberger Druckmaschinen Aktiengesellschaft, Heidelberg, Germany

[22] Filed: Dec. 22, 1975

[21] Appl. No.: 642,696

[30] Foreign Application Priority Data

Dec. 20, 1974 Germany ..... 2460504

[52] U.S. Cl. ..... 271/276; 271/197

[51] Int. Cl.[2] ..... B65H 5/22

[58] Field of Search ..... 271/276, 197, 196, 94, 271/95, 96, 275, 108; 198/184, 689

[56] References Cited

UNITED STATES PATENTS

| | | | |
|---|---|---|---|
| 1,077,400 | 11/1913 | Droitcour | 271/197 |
| 2,764,407 | 9/1956 | Alix | 271/108 |
| 3,197,201 | 7/1965 | Craig | 271/197 |
| 3,621,998 | 11/1971 | Prochaska | 271/197 X |

*Primary Examiner*—Evon C. Blunk
*Assistant Examiner*—Bruce H. Stoner, Jr.
*Attorney, Agent, or Firm*—Herbert L. Lerner

[57] ABSTRACT

A sheet transfer device of a printing press includes a plurality of conveyor belts of relatively narrow cross section compared to the width of a sheet being transferred thereby, and an elongated suction chamber formed with an elongated orifice extending in the direction of sheet transfer. Sealing beads formed at each end of the orifice cooperate with the belts at each side of the orifice to form a sealing extension of the elongated orifice.

8 Claims, 3 Drawing Figures

Fig. 1
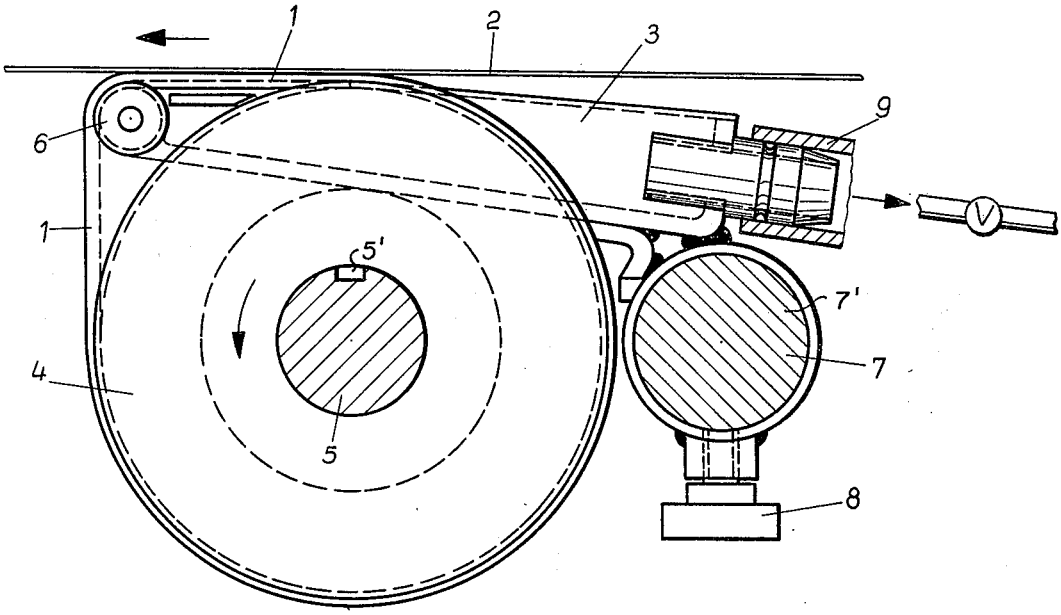
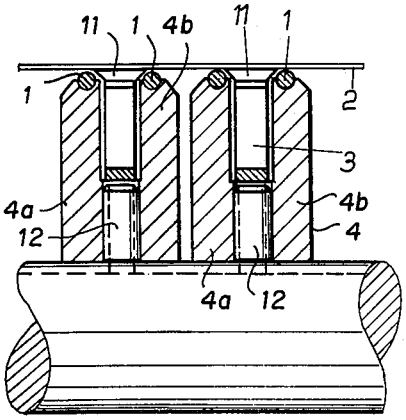
Fig. 2
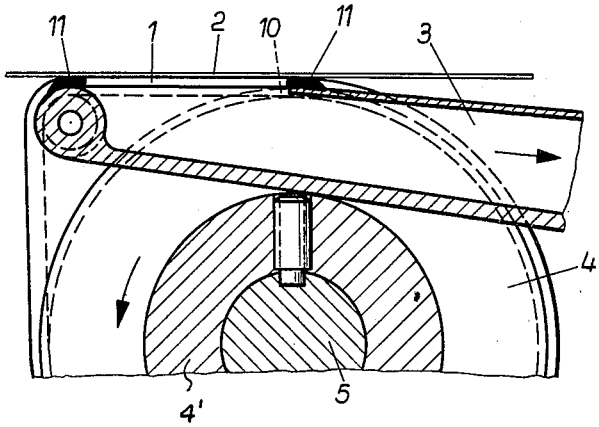
Fig. 3

SHEET TRANSFER DEVICE FOR PRINTING PRESSES

The invention relates to a sheet transfer or transport device for a printing press and more particularly, to such a transfer device having suction chambers which apply suction to a sheet being transferred on transporting means.

Heretofore known sheet transfer or transport devices of this general type, employ a relatively wide perforated conveyor belt which is guided over a suction chamber so that suction is exerted on the transported sheet only through the perforation formed in the wide belt (German Petty Patent DT-GBM 1,976,230). Only a relatively weak suction effect can be exerted upon the sheet through the perforation in the conveyor belt, in spite of high vacuum. on the other hand, the wide conveyor belt of the heretofore known type is itself sucked strongly against the large orifice of the suction chamber and is thus braked. A consequence thereof is that considerably higher power is required to drive the conveyor belt. The wide conveyor belt is often not usable if, especially in the case of presses that print on either one or both sides of a sheet, namely perfector presses, non printed areas of insufficient width exist on the sheet.

It is accordingly an object of the invention to provide a sheet transfer or transport device which avoids the foregoing disadvantages of the heretofore known devices of this general type and which is of narrow dimension and enables the development of high suction power for a relatively slight negative pressure without having any significant effect upon the travel of the conveyor belt.

With the foregoing and other objects in view, there is provided, in accordance with the invention, a sheet transfer device of a printing press comprising a plurality of conveyor belts of relatively narrow cross section compared to the width of a sheet being transferred thereby, and suction-producing means disposed in vicinity of the plurality of conveyor belts. With such a construction, the entire suction orifice can apply suction to the sheet without being masked by a perforated belt. The suction power consequently increases even for a relatively slight negative pressure.

In accordance with another feature of the invention, the conveyor belts of narrow cross section extend substantially parallel to one another in sheet transferring direction, and the suction-producing means is disposed therebetween.

In accordance with a further feature of the invention, the suction-producing means comprise an elongated suction chamber, the conveyor belts of narrow cross section extending along the elongated suction chamber at both sides thereof. The disposition of the conveyor belts along both sides of the suction chamber assures reliable sealing and accurate sheet transport.

In accordance with an added feature of the invention, the cross section of the conveyor belt is circular.

In accordance with an additional feature of the invention, the sheet transfer device includes respective drive and reversing rollers for the conveyor belts, the drive and reversing rollers and the conveyor belts in common with the suction chamber being displaceable in a direction transverse to the sheet transferring direction. The possibility is thereby provided of adjusting the sheet transfer or transport device to underlie an unprinted strip of the sheet, this being facilitated by the relatively narrow width of the sheet transfer device.

In accordance with the invention, the suction-producing means include a plurality of the elongated suction chambers, and the plurality of conveyor belts of narrow cross section include a conveyor belt on each side of each of the plurality of elongated suction chambers, and further including respective drive and reversing rollers for the respective pairs of conveyor belts located at both sides of the respective suction chambers, the drive and reversing rollers and the conveyor belts being displaceable in common with the suction chambers in a direction transverse to the sheet transferring direction.

In accordance with yet another feature of the invention, the elongated suction chamber is formed with an elongated orifice extending in the sheet transferring direction, and the sheet transfer device further includes a sealing bead respectively bounding the forward and rearward ends of the elongated orifice. Assurance is thereby provided that even stiff sheet material is reliably sucked and transported or braked.

In order to adapt the embodiment of the invention optimally to practical requirements the elongated orifice extends along a line, substantially from a point of tangency thereof with the drive roller to a point of tangency thereof with the reversing roller. In addition, the line along which the elongated orifice extends is substantially perpendicular to respective radii of the drive roller and the reversing roller at the respective point of tangency. The mean spacing between the drive roller and the reversing or return roller is readily adaptable structurally to the required transfer or transport power.

In accordance with a concomitant feature of the invention, the suction producing means are adjustable for varying the intensity of suction.

Other features which are considered as characteristic for the invention are set forth in the appended claims.

Although the invention is illustrated and described herein as embodied in a sheet transfer device for printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a side elevational view, partly in section, of the sheet transferring device constructed in accordance with the invention, FIG. 2 is an enlarged, fragmentary cross-sectional view of FIG. 1 showing a suction chamber and a drive pulley thereof; and FIG. 3 is a fragmentary view of FIG. 1, additionally in longitudinal section at the suction chamber and drive and return pulleys thereof.

Referring now to the figures of the drawing, there is shown therein, a sheet transferring or transport device of a printing press according to the invention which includes a plurality of transporting or transferring devices that are disposed transversely to the direction of transport or transfer of the sheets. The function of such a sheet transferring device is to transfer or transport a sheet accurately without damaging it. For this purpose the illustrated embodiment of the invention employs conveyor belts 1 upon which a sheet is disposed. Preferably, relatively narrow conveyor belts are used that are located laterally of suction chambers 3, the drive of the conveyor belts being effected through drive pulleys 4 that are mounted on a shaft 5. In order to prolong the period during which the sheet 2 remains in contact with the conveyor belts 1, return or reversing pulleys 6 are rotatably mounted on the suction chamber 3.

A plurality of suction chambers 3 are displaceably disposed on a cross member or traverse 7 and are clamped thereto by means of screws 8. A hose connection 9 supplies suction air to the suction chambers 3. As shown especially in FIG. 3, the suction chambers 3 are provided with orifice 10 in a forward region in direction of travel of the sheet 2 being transferred and, also considered in the transfer or transport direction of the sheet 2, the orifices 10 are bounded at the respective beginning and end thereof by sealing beads 11. In this manner, the suction effect is increased, and the losses of suction air are reduced.

To simplify the construction of the conveyor belts 1, they are formed with a circular cross-section, as shown in FIG. 2. Depending upon the sheet material to be processed, the intensity of the suction air may be increased or reduced. If thin paper, for example, is being processed, then a relatively slight negative pressure of the suction air is sufficient to ensure an accurate transfer or transport. The length of the orifice 10 in the suction chamber 3 and, accordingly, the spacing between the center of the drive pulley 4 and the center of the reversing or return pulley 6 can also be increased or reduced depending upon practical requirements. For example, if predominantly stiff sheet material is to be processed, a longer suction orifice may prove to be advantageous.

As is readily apparent from FIGS. 2 and 3, the drive roller 4 is formed with a hub 4′ and two flange parts 4*a* and 4*b*. The suction chamber 3 is disposed between the flange parts 4*a* and 4*b* as seen in FIGS. 1 and 2. The conveyor belts 1 respectively ride in recesses formed at the peripheries of the flange parts 4*a* and 4*b* and in the periphery of the reversing roller 6.

The drive shaft 5 provided with a keyway 5′. A key in the form of a pin 12 threadably secured in a corresponding threaded bore formed in the hub 4′ is slidably received in the keyway 5′.

The suction chamber 3, as shown diagrammatically in FIG. 1 is secured by welds to a tube 7′ slidably mounted on the cross piece or traverse 7 which is suitably fixed to the frame of the printing press. The tightening screw 8 extends through a bore in the tube 7′ and can be tightened or loosened as desired, in order to adjust the assembly in the direction transverse to the sheet transfer direction represented by the arrow at the upper left-hand side of FIG. 1.

As is readily apparent though not specifically illustrated, one or more additional drive rollers 4 with respective pairs of conveyor belts 1, reversing rollers 6, suction chambers 3 and suction air hose connections 9 can be welded to the tube 7′ at a given spacing one from the other, the key pins 12 of the additional assemblies being received in the keyway 5′. Thus, by suitable loosening of the screw or screws 8, transverse adjustment of the assemblies as a unit may be effected.

To vary the intensity of the suction air in the hose connection 9 which leads to a conventional suction-producing device, a suitable valve may be provided in the line of the hose connection 9 for controlling the suction air flow therethrough.

There is claimed:

1. In a printing press, a sheet transfer device comprising a plurality of conveyor belts of relatively narrow cross section compared to the width of a sheet being transferred thereby, and suction-producing means disposed in vicinity of said plurality of conveyor belts, said suction-producing means comprising an elongated suction chamber formed with an elongated orifice extending in the sheet transferring direction and having a sealing bead respectively located at the forward and rearward ends of said elongated orifice in the sheet transferring direction and between said belts, each sealing bead extending outwardly from said orifice so as to underlie and engage a sheet supported by said belts, said conveyor belts of relatively narrow cross section extending along said elongated orifice at the opposite elongated sides of said elongated suction chamber and forming with said sealing beads a sealing extension of said elongated orifice of said suction chamber underlying the sheet being transferred.

2. A sheet transfer device according to claim 1 wherein said conveyor belts of narrow cross section extend substantially parallel to one another in sheet transferring direction, and said suction-producing means is disposed therebetween.

3. A sheet transfer device according to claim 1 wherein said cross section of said conveyor belts is ascular.

4. A sheet transfer device according to claim 1 including respective drive and reversing rollers for said conveyor belts, and mean for displacing said drive and reversing rollers and said conveyor belts in common with said suction chamber in a direction transverse to the sheet transferring direction.

5. A sheet transfer device according to claim 4 wherein said elongated orifice extends along a line substantially from a point of tangency thereof with said drive roller to a point of tangency thereof with said reversing roller.

6. A sheet transfer device according to claim 5 wherein the like along which said elongated orifice extends is substantially perpendicular to respective radii of said drive roller and said reversing roller at the respective points of tangency.

7. A sheet transfer device according to claim 1 wherein said suction-producing means include a plurality of said elongated suction chambers, and said plurality of conveyor belts of narrow cross section include a conveyor belt on each side of each of said plurality of elongated suction chambers, and further including respective drive and reversing rollers for the respective pairs of conveyor belts located at both sides of the respective suction chambers, and means for displacing said drive and reversing rollers and said conveyor belts in common with said suction chambers in a direction transverse to the sheet transferring direction.

8. A sheet transferring device according to claim 1 wherein said suction-producing means are adjustable for varying the intensity of suction.

* * * * *